United States Patent [19]

Kojima

[11] Patent Number: 4,552,186

[45] Date of Patent: Nov. 12, 1985

[54] WARP LET-OFF MECHANISM OF WEAVING MACHINE

[75] Inventor: Shuichi Kojima, Tokyo, Japan

[73] Assignee: Nissan Motor Co., Ltd., Yokohama, Japan

[21] Appl. No.: 556,692

[22] Filed: Nov. 30, 1983

[30] Foreign Application Priority Data

Dec. 2, 1982 [JP] Japan ..... 57-210597
Jul. 26, 1983 [JP] Japan ..... 58-135125

[51] Int. Cl.[4] ..... D03D 49/06
[52] U.S. Cl. ..... 139/100; 139/110
[58] Field of Search ..... 139/100, 110, 105, 97, 139/99, 1 R, 336; 66/209–212

[56] References Cited

U.S. PATENT DOCUMENTS

| | | | |
|---|---|---|---|
| 2,737,209 | 3/1956 | Meyer | 139/110 |
| 3,753,451 | 8/1973 | Hosono et al. | 139/110 |
| 3,934,620 | 1/1976 | Garcia | 139/110 X |

FOREIGN PATENT DOCUMENTS

| | | | |
|---|---|---|---|
| 45-37180 | 11/1970 | Japan | 139/110 |
| 51-17332 | 5/1976 | Japan . | |
| 56-68140 | 6/1981 | Japan . | |
| 629549 | 4/1982 | Switzerland | 139/110 |
| 969973 | 9/1964 | United Kingdom | 139/1 R |
| 1054563 | 1/1967 | United Kingdom | 139/100 |

*Primary Examiner*—James Kee Chi
*Attorney, Agent, or Firm*—Schwartz, Jeffery, Schwaab, Mack, Blumenthal & Evans

[57] ABSTRACT

A warp let-off mechanism of a weaving machine has a speed change transmission whose output rotation is in one direction irrespective of whether its input rotation is in the forward or reverse direction. The speed change transmission has shift means for selectively changing the direction of the output rotation between the forward and reverse directions. The speed change transmission can change the ratio between the input speed and output speed in accordance with warp tension sensed by warp tension sensing means. There is further provided interlock means connected between the shift means of the speed change transmission and an operating lever or other operating device of the weaving machine. The interlock means moves the shift means in accordance with the movement of the operating lever so as to match the direction of the warp beam rotation to the operation of the weaving machine. Optionally, there is further provided shift error stop means which stops the movement of the weaving machine if the shift means is not shifted to a correct position by the interlock means.

23 Claims, 21 Drawing Figures

WARP LET-OFF MECHANISM OF WEAVING MACHINE

BACKGROUND OF THE INVENTION

The present invention relates to a warp let-off mechanism of a weaving machine, having a speed change transmission for changing the speed of the warp beam rotation in accordance with warp tension. More specifically, the present invention relates to a device for changing the direction of the warp beam rotation.

In a positive warp let-off mechanism of a known type, there are provided a back roller for sensing warp tension, and a speed change transmission for changing the speed of the warp beam rotation in accordance with the warp tension. The warp yarns are released from the warp beam, and introduced to the heald through the back roller. The back roller is acted upon by the warp tension, and moves in accordance with the warp tension. The speed change transmission is connected with the back roller. The speed change transmission increases the warp letting off rate if the warp tension increases beyond an allowable range, and decreases the warp letting off rate if the warp tension decreases below the allowable range. In this way, this warp let-off mechanism automatically controls the warp tension within the allowable range.

Japanese Utility Model examined publication No. Sho 51-17332 discloses one type of such a speed change transmission. In this speed change transmission, there are provided a plurality of eccentrics mounted on an input shaft, and a plurality of control arms swingable on a common shaft whose position is changed in accordance with the warp tension. The eccentrics are connected with the control arms, individually, in such a manner that the eccentrics converts the rotation of the input shaft into a reciprocating motion, and the stroke of the reciprocating motion is varied in accordance with the position of the common shaft determined by the warp tension. This reciprocating motion is transmitted to an output shaft, and converted to a rotation of the output shaft by a freewheel mechanism (a one-way clutch). Thus, the warp beam is driven by the output shaft rotation while the ratio between the input speed and the output speed is controlled in accordance with the position of the common shaft.

In this speed change transmission, the output shaft rotation is always fixed in the forward direction irrespective of whether the direction of the weaving machine movement is forward or reverse, because this speed change transmission utilizes the reciprocating motion. The warp beam is driven in the forward direction both when the weaving machine is driven in the forward direction and when the weaving machine is driven in the reverse direction.

When the weaving machine is stopped and then moved in the reverse direction in order to repair a mispick or other malfunction, this speed change transmission drives the warp beam in the forward direction whereas a surface roller on the fabric take-up side is rotated in the reverse direction. Therefore, the warp yarns become very slack, and the back roller moves so that the ratio of the input and output speeds changes extremely. Therefore, very troublesome and time-consuming preparations for readjusting the warp tension and other conditions are required for restarting the weaving operation every time the weaving machine is stopped and moved in the reverse direction.

In one type of such a speed change transmission, there is further provided a shift mechanism which can change the direction of the output shaft rotation from the forward direction to the reverse direction and vice versa. If, however, the shift mechanism is operated incorrectly, there arises a dagerous condition in which the weaving machine is driven in the forward direction whereas the warp beam is driven in the reverse direction. In this condition, the warp tension rises to an abnormal level, so that there is a fear of breakage of many warp threads, and a serious defect of a woven fabric.

SUMMARY OF THE INVENTION

It is an object of the present invention to provide a weaving system in which the direction of the warp beam rotation is automatically controlled so as to match to the direction of the weaving machine movement.

According to the present invention, the weaving system comprises driving means, a weaving mechanism, operating means, and interlock means. The weaving mechanism is connected with the driving means, and driven by the driving means in a forward direction and a reverse direction. The weaving mechanism comprises a main mechanism and a warp let-off mechanism. The warp let-off mechanism comprises a warp beam, means for sensing warp tension, and speed change means. The speed change means is connected with the driving means, and driven by the driving means in the forward or reverse direction by receiving an input rotation. The speed change means is connected with the warp beam for driving the warp beam by transmitting an output rotation to the warp beam. The speed change means is connected with the warp tension sensing means, and capable of changing a ratio between the input speed of the input rotation and the output speed of the output rotation thereby to change the speed of the warp beam rotation. The speed change means has shift means for changing the direction of the output rotation. The shift means has a forward shift position and a reverse shift position. The speed change means drives the warp beam in the forward direction when the shift means is in the forward shift position irrespective of whether the input rotation is in the forward direction or in the reverse direction. The speed change means drives the warp beam in the reverse direction when the shift means is in the reverse shift position irrespective of whether the input rotation is in the forward direction or the reverse direction. The operating means, such as an operating lever or a set of switches, is connected with the driving means for controlling the operation of the weaving mechanism. The operating means has a forward operation position and a reverse operation position. The driving means drives the weaving mechanism in the forward direction when the operating means is in the forward operation position, and in the reverse direction when the operating means is in the reverse operation position. The interlock means is connected with the operating means and the shift means of the speed change means. The interlock means brings the shift means to the forward shift position when the operating means is in the forward operation position, and to the reverse shift position when the operating means is in the reverse operation position.

The weaving system may further comprises shift error stop means for detecting an error condition in which the shift means is in the forward shift position while the operating means is in the reverse operation position, or the shift means is in the reverse shift position while the operating means is in the forward operation position. The shift error stop means is connected with the driving means for causing the driving means to stop the motion of the weaving mechanism if the error condition continues during a predetermined time interval.

DETAILED DESCRIPTION OF THE INVENTION

Figure 1:
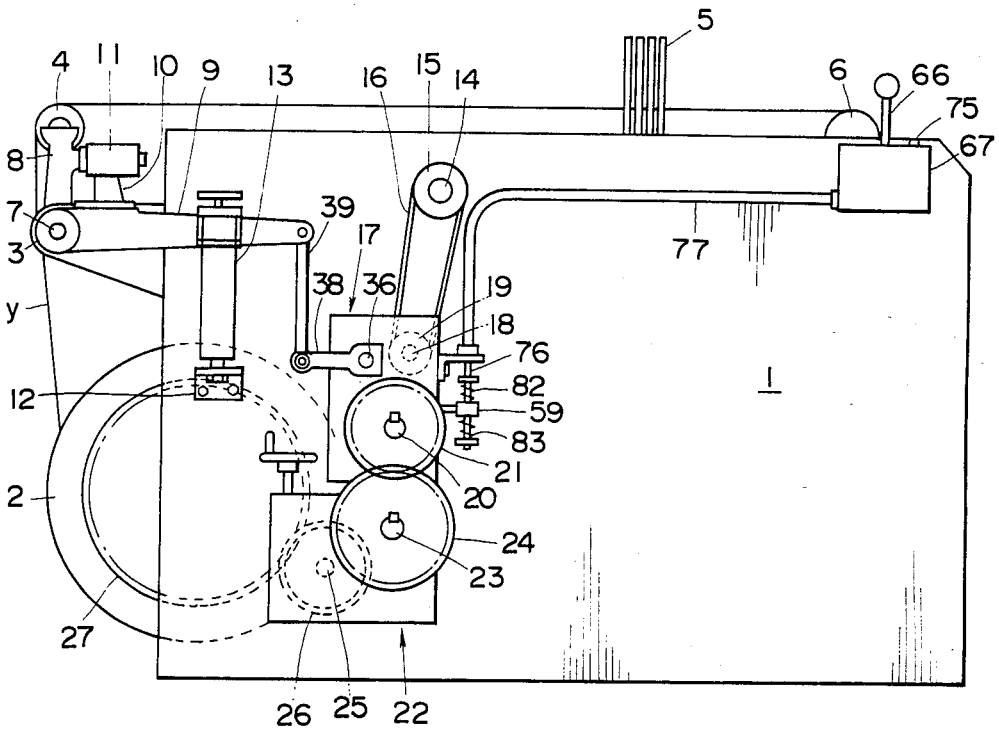
FIG. 1 is a view of a weaving machine according to a first embodiment of the present invention.

The first embodiment of the present invention is shown in FIGS. 1 to 11. In FIG. 1, a weaving machine has a loom frame 1 and a warp beam 2. Warp yarns or threads y are wound on the warp beam 2, and released from the warp beam 2. Guide roller 3 and back roller 4 change the direction of the warp y. The warp y is then introduced into a heald or heddle 5. The weaving machine further has a breast beam 6.

The back roller 4 is supported on a top end of an upward support arm 8 pivoted on a shaft 7 of the guide roller 3. A tension lever 9, too, is pivoted on the shaft 7 of the guide roller 3. The tension lever 9 has an upward driven arm 10. The upward support arm 8 abuts against the upward driven arm 10 of the tension lever 9 through a buffer 11 having a compression spring for absorbing a periodical fluctuation of warp tension. A spring device 13 having a compression spring is disposed between a portion of the tension lever 9 located near a swingable end of the tension lever 9 and a bracket 12 fixed to the loom frame 1. With the spring device 13, the tension lever 9 tends to rotate in the counterclockwise direction as viewed in FIG. 1, and thus provides tension to the warp y through the back roller 4.

The warp beam 2 is driven by a main shaft 14 of the loom. A sprocket wheel 15 is fixed to the main shaft 14. A chain 16 connects the sprocket wheel 15 with a sprocket wheel 19 fixed to an input shaft 18 of a speed change transmission 17. The rotation of the main shaft 14 is transmitted through the chain 16 to the input shaft 18 of the speed change transmission 17. A gear 21 fixed to an output shaft 20 of the speed change transmission 17 is in mesh with a gear 24 fixed to an input shaft 23 of a speed reducer 22. A gear 26 fixed to an output shaft 25 of the speed reducer 22 is in mesh with a gear 27 which is integral with the warp beam 2. Being driven by the main shaft 14 through the speed change transmission 17 and the speed reducer 22, the warp beam 2 lets off the warp y.

Figure 4:
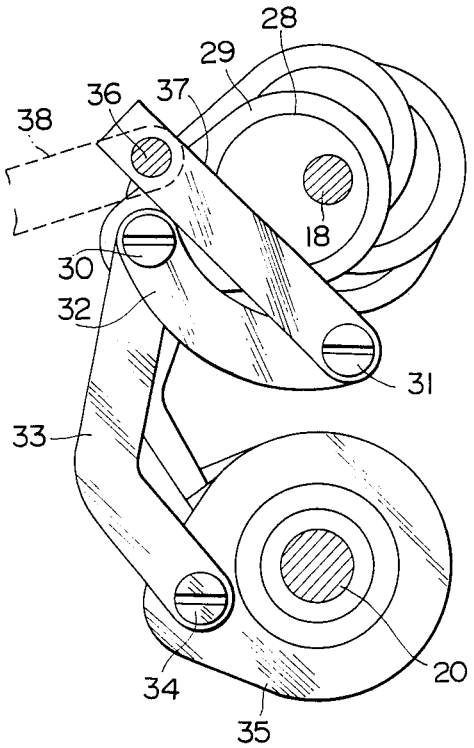
FIG. 4 is a front view of an internal mechanism of the speed change transmission.

As shown in FIG. 4, the speed change transmission 17 has a plurality of eccentric inner discs 28 and eccentric outer rings 29. The eccentric inner discs 28 are fastened eccentrically around the input shaft 18, so that they are rotatable with the input shaft 18. The eccentric inner discs 28 are received and rotate in the eccentric outer rings 29, individually. Each of the eccentric outer rings 29 has a lobe which is swingably connected by a pin 30 to one end of a control arm 32. The lobe of each eccentric outer ring 29 is further connected swingably by the pin 30 to one end of a connecting arm 33. The other end of each of the control arms 32 is swingably connected to a common shaft 31. The other end of each of the connecting arms 33 is connected to a lobe of a driven ring 35 by a pin 34. When the input shaft 18 rotates in either of the forward and reverse directions, the control arms 32 swings on the common shaft 31, and the connecting arms 33 moves in a reciprocating manner irrespective of whether the direction of the rotation of the input shaft 18 is forward or reverse. Thus, the forward and reverse rotations of the input shaft 18 are converted to a reciprocating angular movement of the driven rings 35.

The common shaft 31 is rotatably supported on a yoke 37, which is connected to a shaft 36. The shaft 36 is rotatably supported on a transmission case 40. A speed change lever 38 is fastened to the shaft 36. The position of the common shaft 31 can be changed by shifting the speed change lever 38. In accordance with the position of the common shaft 31 on which the control arms 32 swings, the stroke of the reciprocating motion of the connecting arms 33 is changed, so that the degree of the reciprocating angular movement of the driven rings 35 can be changed.

The speed change lever 38 is connected, through a rod 39 as shown in FIG. 1, to the tension lever 9 so that the speed change lever 38 is shifted in accordance with warp tension.

Figure 5:
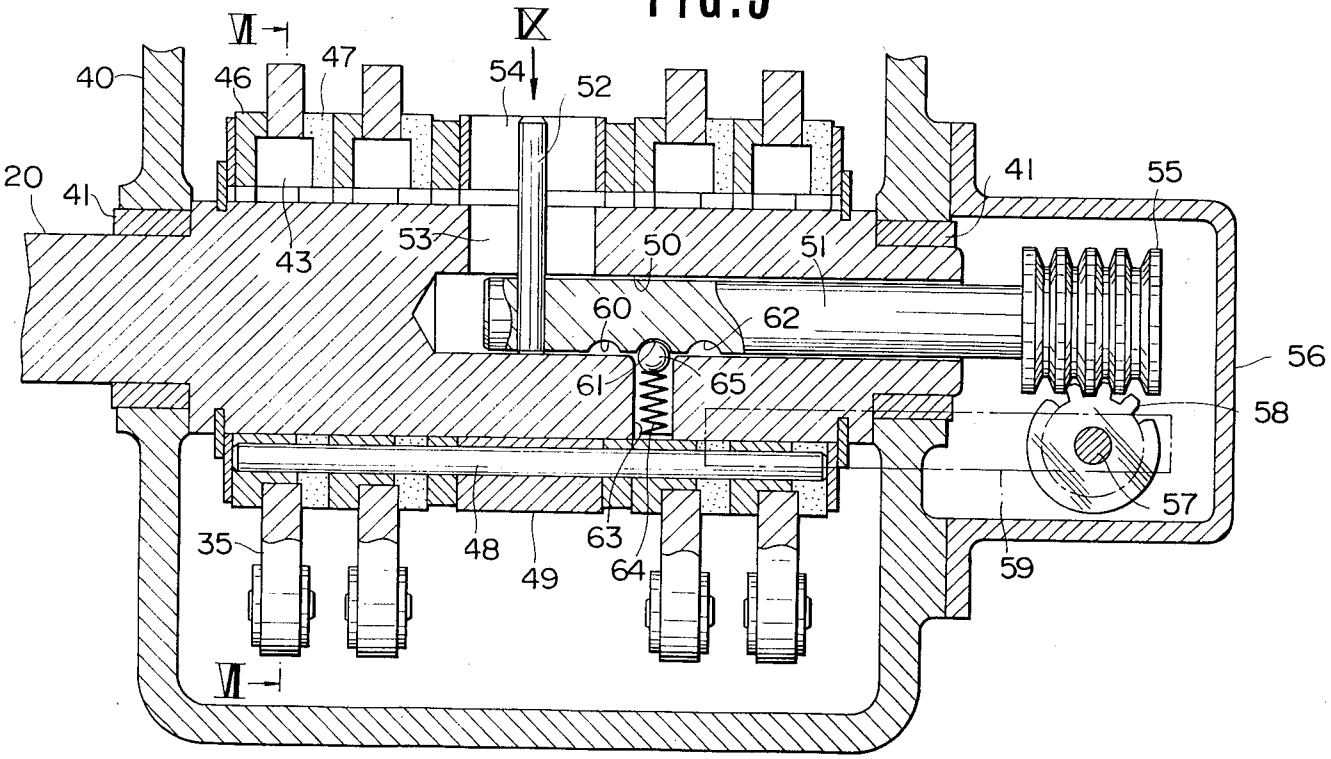
FIG. 5 is a sectional side elevation of an output shaft and its surroundings of the speed change transmission.
Figure 6:
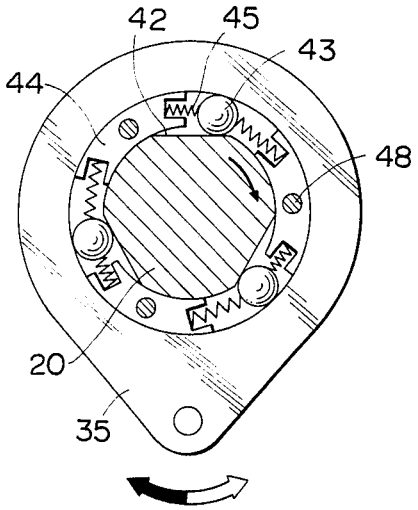
FIGS. 6 to 8 are sectional views taken along a line VI—VI of FIG. 5, showing various operating conditions.

As shown in FIG. 5, the output shaft 20 is rotatably supported on side walls of the transmission case 40 through bearings 41. Each of the driven rings 35 is mounted on the output shaft 20 through a one-way clutch, as shown in FIG. 6.

For each of the driven rings 35, the output shaft 20 is formed with a set of recesses 42 which are arranged circumferentially around the periphery at regular intervals. Each recess 42 has a roller 43 which is disposed between the bottom of the recess 42 and the driven ring 35. There are provided arc members 44 each of which is interposed between a neighboring pair of the rollers 43. Each of the arc members 44 is disposed slidably between the outer surface of the output shaft 20 and the inner surface of the driven ring 35. A spring 45 is disposed between each neighboring pair of the roller 43 and the arc member 44. Each of the driven rings 35 is sandwitched between cover rings 46 and 47 which cover the annular space formed between the output shaft 20 and the driven ring 35. Each of the arc members 44 is rotatable relative to the output shaft 20, and integral with one of the cover ring 46 and 47.

The arc members 44 and the cover rings 46, 47 are integrated into a single unit by common shafts 48 which pass through these members. The common shafts 48 are supported by a shift ring 49 which is rotatably mounted on the output shaft 20.

Figure 9:
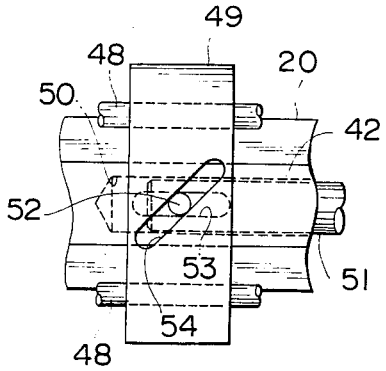
FIG. 9 is a view taken in a direction of IX of FIG. 5.

The output shaft 20 is formed with a guide hole 50 which extends along the axis of the output shaft 20. A shift rod 51 is inserted into and slidable in the guide hole 50 of the output shaft 10. A radially extending pin 52 is fixed to an inner end of the shift rod 51. The output shaft 20 is further formed with an axially elongated slot 53 which extends radially from the guide hole 50 and opens to the outside. The pin 52 passes radially through the slot 53, so that the outputshaft 20 and the shift rod 51 rotates together. The shift ring 49 is formed with a slant slot 54 which is elongated obliquely as shown in FIG. 9. The pin 52 passes radially through the slant slot 54 of the shift ring 49. Therefore, when the shift rod 51 moves axially, the shift ring 49 is compelled to rotate relative to the output shaft 20.

The shift rod 51 projects axially out of the guide hole 50. An outer end of the shift rod 51 is integrally formed with a cylindrical rack 55. The cylindrical rack 55 is engaged with a pinion 58 fixedly mounted on a shaft 57 which is supported on a case 56. The shaft 57 is connected to a forward-reverse shift lever 59. The shift rod 51 can be axially moved by operating the forward-reverse shift lever 59. The shift rod 51 is formed with three recesses 60, 61 and 62 which are axially aligned. The output shaft 20 is formed with a radial hole 63, which contains a spring 64 and a lock ball 65. The lock ball 65 can engage with any one of the recesses 60, 61 and 62.

When the forward-reverse shift lever 59 is turned in clockwise direction as viewed in FIG. 5, the cylindrical rack 55 and the pinion 58 cooperate to move the shift rod 51 rightward in FIG. 5 into a forward position in which position the lock ball 65 engages with the recess 60. During this, the pin 52 moves rightward as viewed in FIG. 9, and by so doing, causes the shift ring 49 to rotate relative to the output shaft 20 with the help of the slant slot 54. Consequently, the arc members 44 rotate in clockwise direction as shown in FIG. 6 with respect to the output shaft 20, because the arc members 44 are integral with the shift ring 49 through the common shafts 48. Thus, the rollers 43 are pushed in clockwise direction by the arc members 44 as shown in FIG. 6.

In this state, only the clockwise rotational movement of the driven rings 35, as viewed in FIG. 6, is transmitted to the output shaft 20 through the roller 43, while the driven rings 35 moves back and forth rotationally. Therefore, the output shaft 20 rotates intermittently in a clockwise direction as viewed in FIG. 6. This direction of the output shaft rotation is a forward direction, that is, a warp letting off direction.

Figure 7:
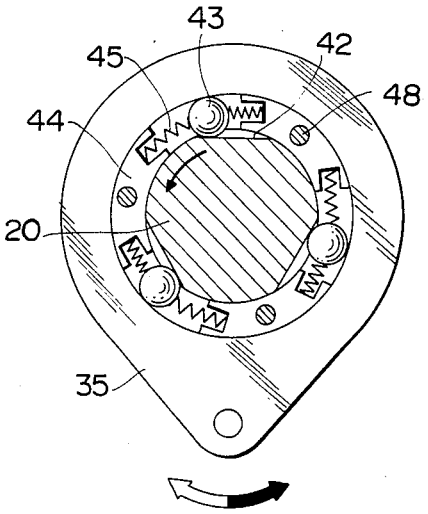
Figure 8:
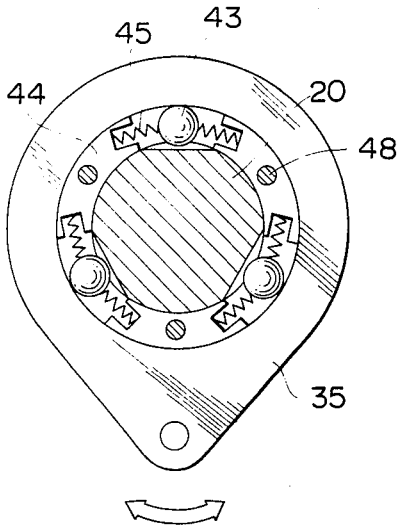

When the forward-reverse shift lever 59 is turned in a counterclockwise direction as viewed in FIG. 5, the shift rod 51 moves leftward as viewed in FIG. 5 by the action of the cylindrical rack 55 and the pinion 58, and the lock ball 65 is received in the recess 62. With this linear movement of the shift rod 51, the pin 52 moves leftward as viewed in FIG. 9, and the shift ring 49 rotates with respect to the output shaft 20 with the help of the slant slot 54. Thus, the arc members 44 rotates integrally with the shift ring 49 in a counterclockwise direction as shown in FIG. 7 with respect to the output shaft 20, and push the roller 43 in the same direction.

In this state, only the counterclockwise rotation of the driven rings 35 is transmitted to the output shaft 20 through the rollers 43 while the driven rings 35 moves back and fourth rotationally. Thus, the output shaft rotates intermittently in a counterclockwise direction as viewed in FIG. 7, which is a reverse direction opposite to the forward direction.

When the forward-reverse shift lever 59 is in an intermediate position as shown in FIG. 5, the shift rod 51 is in an idle position in which position the lock ball 65 engages with the recess 61 lying between the recesses 60 and 62. Thus, the arc members 44 move, through the action of the pin 52, the shift ring 49 and the common shafts 48, into a position shown in FIG. 8, relative to the output shaft 20. In this position, each of the rollers is in the middle of the recess 42 and has play.

In this state, neither of the clockwise and counterclockwise rotations of the driven rings 35 is transmitted to the output shaft. Thus, the driven rings move back and fourth rotationally, but the output shaft 20 does not rotate.

Thus, the stepless speed change transmission 17 has three positions, a forward position in which the output shaft rotate in the forward direction irrespective of the direction of the input shaft rotation, a reverse position in which the output shaft rotates in the reverse direction irrespective of the direction of the input shaft rotation, and an idle position in which the output shaft is not driven. The ratio of input speed to output speed is changed in accordance with the tension of the warp threads.

The forward-reverse shift lever 59 of the speed change transmission 17 is connected with a loom operating lever 66, as shown in FIG. 1.

Figure 10:
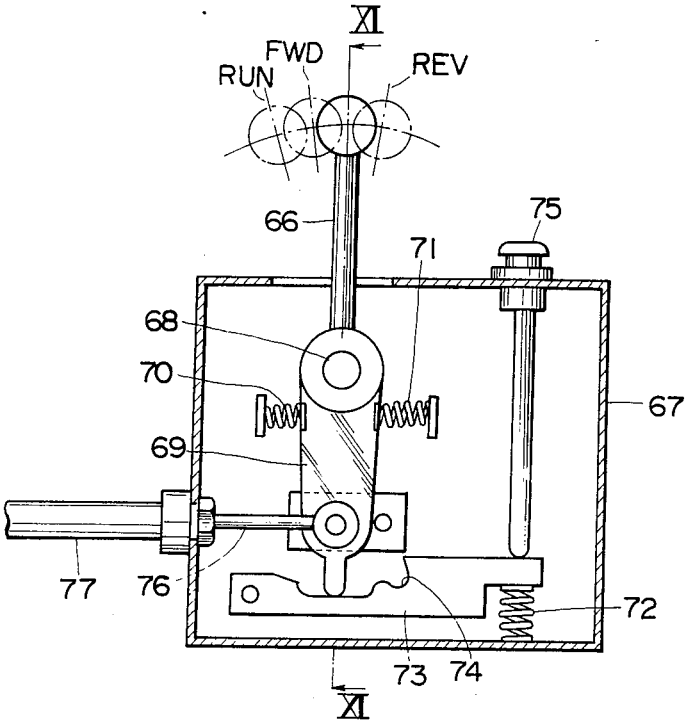
FIG. 10 is a sectional view of an operation control box shown in FIG. 1.
Figure 11:
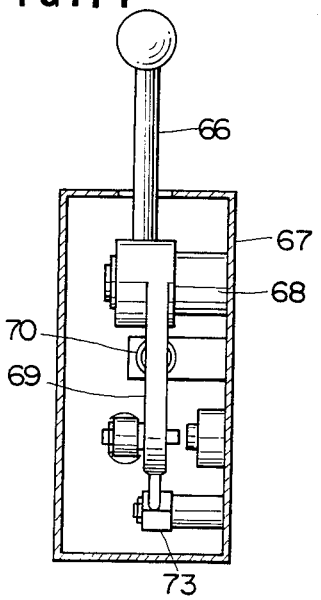
FIG. 11 is a sectional view taken along a line XI—XI of FIG. 10.

As shown in FIGS. 10 and 11, the loom operating lever 66 is fixed to a boss portion of an arm 69 which is supported on a shaft 68 mounted in a box 7. The operating lever 66 is normally held in a stop position by springs 70 and 71 which exert forces on the arm 69 so as to center the arm 69. The operating lever 66 can be shifted by hand to a run (forward) position, a forward inching position and a reverse inching position. If the operating lever 66 is unhanded and released at the forward inching position or the reverse inching position, the operating lever 66 automatically returns from the forward or reverse inching position to the stop position. When the operating lever 66 is shifted to the run position, the end of the arm 69 moves into a recess 74 of a lock lever 73 which is acted upon by a force of a spring 72, and thus the operating lever 66 is locked in the run position. A stop button 75, when pushed, causes the lock lever 73 to move against the force of the spring 72 to unlocks the operating lever 66, so that the operating lever 66 is allowed to return to the stop position. In accordance with the position of the operating lever 66, an electric circuit (not shown) associated with the operating lever 66 operates the loom in respective operating modes.

The arm 69 of the loom operating lever 66 is connected with one end of a release wire 76. The release wire 76 is enclosed in a release tube 77 whose one end is fixed to the box 67.

Figure 2:
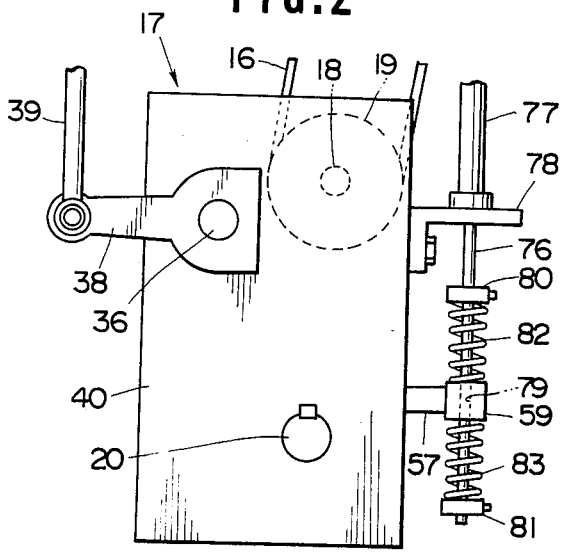
FIG. 2 is a front view of a speed change transmission shown in FIG. 1.
Figure 3:
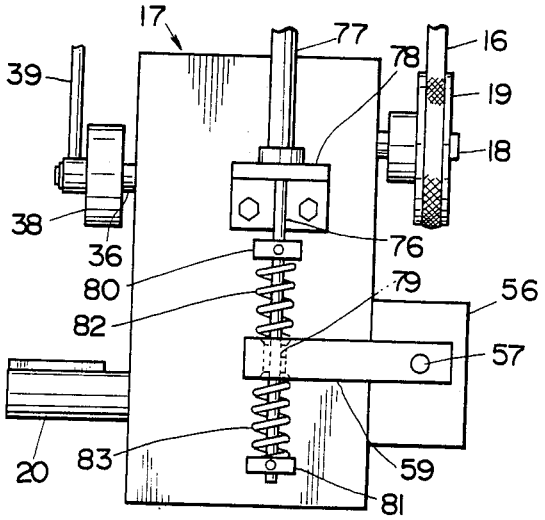
FIG. 3 is a side view of the speed change transmission.

As shown in FIGS. 1, 2 and 3, the other end of the release tube 77 is fixed to a bracket 78 which is fixed to the case 40 of the speed change transmission 17. The other end of the release wire 76 extends out of the release tube 77 and passes through a hole 79 formed in the forward-reverse shift lever 59 of the speed change transmission 17. Spring retainers 80 and 81 are fixed to the release wire 76 on both sides of the forward-reverse shift lever 59. A spring 82 is disposed between the retainer 80 and the forward-reverse shift lever 59. A spring 83 is disposed between the forward-reverse shift lever 59 and the retainer 81.

When the operating lever 66 is shifted to the run position or the forward inching position, the arm 69 of the operating lever 66 pulls the release wire 76, which accordingly moves upward in FIG. 3 and shifts the forward-reverse shift lever 59 through the spring 83. In this case, the forward-reverse lever 59 is caused to rotate in the clockwise direction as viewed in FIG. 3, and shifted to the forward position to move the shift rod 51 to the forward position. The distance through which the release wire 76 is pulled is different between when the operating lever 66 is shifted to the run position and when the operating lever 66 is shifted to the forward inching position. The springs 82 and 83 absorb this difference in the longitudinal movement of the release wire 76.

When the operating lever 66 is shifted to the reverse inching position, the arm 69 pushes the release wire. Accordingly, the release wire 76 moves downward in FIG. 3, and causes the forward-reverse lever 59 to rotate in the counterclockwise direction in FIG. 3 to the reverse position to move the shift rod 51 to the reverse position. Thus, the forward-reverse lever 59 is automatically shifted to the reverse position when the operating lever 66 is shift to the reverse inching position.

When the operating lever 66 is in the stop position, the forward-reverse lever 59 is held in the intermediate position, that is, the idle position, by the release wire 76 and the springs 82 and 83.

Figure 12:
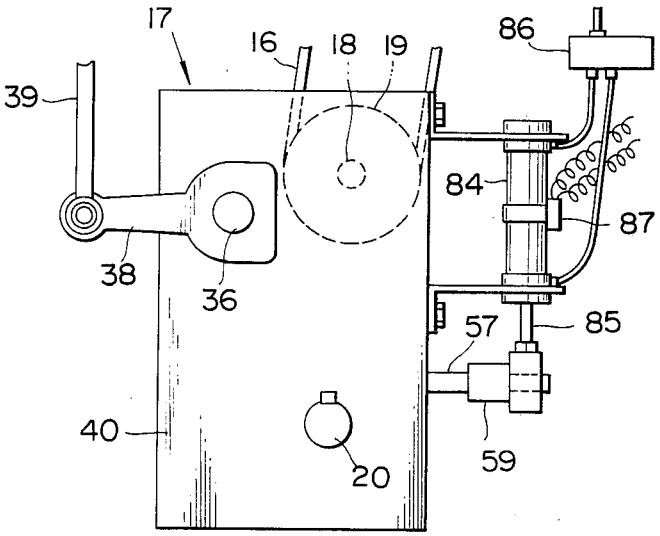
FIG. 12 is a front view of a speed change transmission according to a second embodiment of the present invention.
Figure 13:
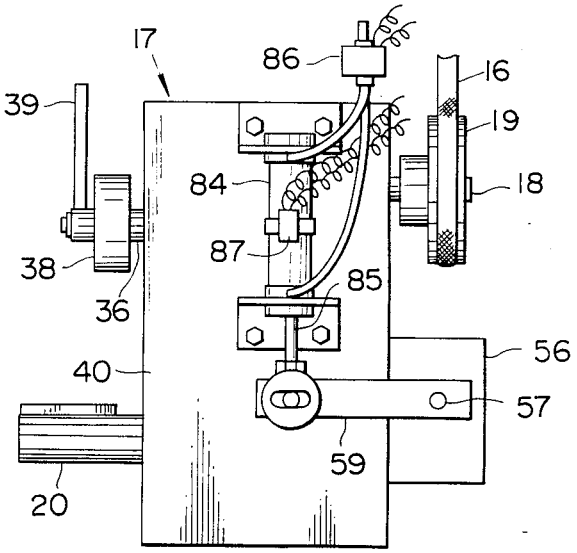
FIG. 13 is a side view of the speed change transmission of FIG. 12.

The second embodiment is shown in FIGS. 12 and 13. In this embodiment, the forward-reverse lever 59 is connected with a piston rod 85 of a double-acting air cylinder 84. The supply of air to both chambers of the air cylinder 84 is controlled by a solenoid valve 86. The solenoid valve 86 is controlled by an electric signal generated in accordance with the position of the operating lever 66 in such a manner that the forward-reverse lever 59 is shifted according to the shift direction of the operating lever 66. In this embodiment, there is further 15 provided a proximity switch 87 for detecting the middle position of the piston of the air cylinder 84. The forward-reverse lever 59 is positioned in the idle position by controlling the solenoid valve 86 with the aid of the proximity switch 87.

Figure 14:
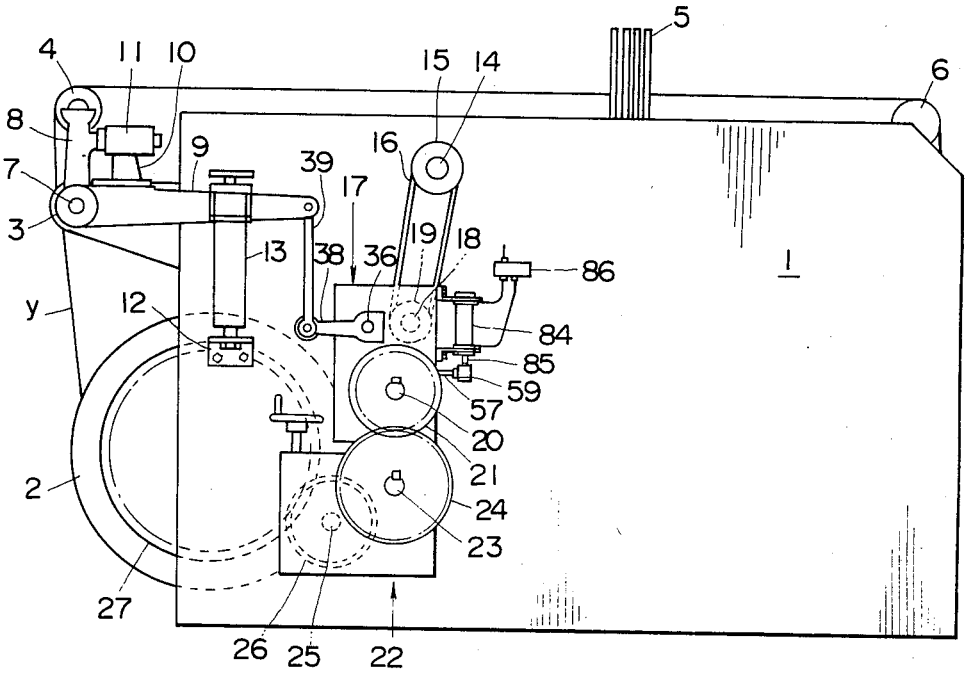
FIG. 14 is a view of a weaving machine according to a third embodiment of the present invention.
Figure 15:
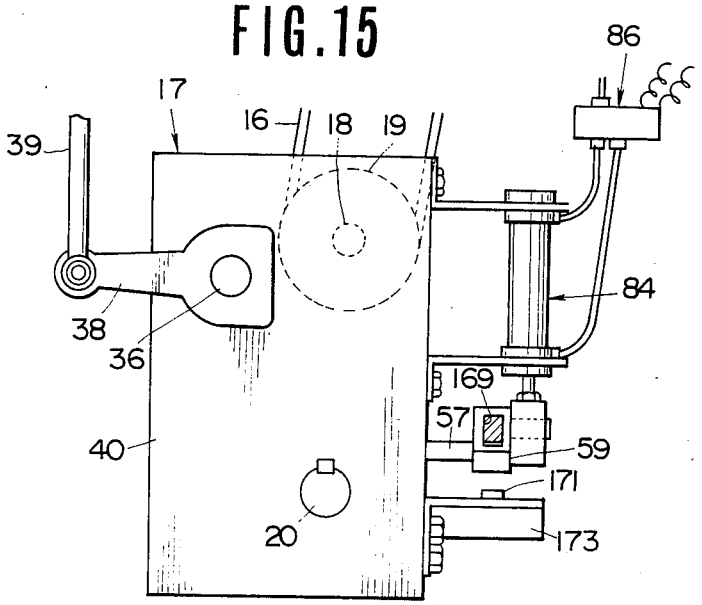
FIG. 15 is a front view of a speed change transmission shown in FIG. 14.
Figure 16:
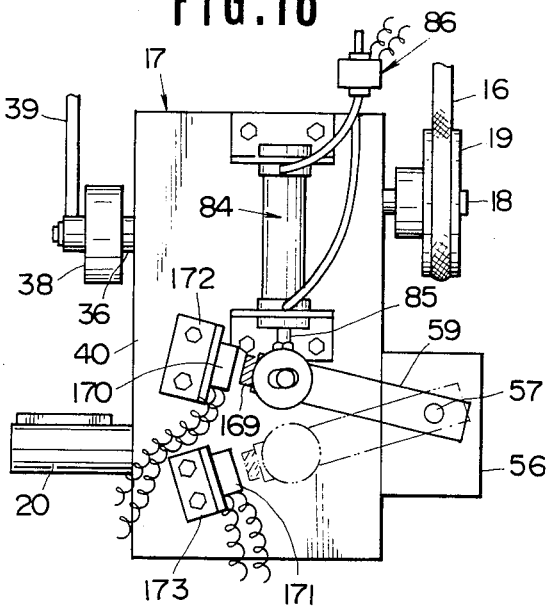
FIG. 16 is a side view of the speed change transmission of FIG. 15.

The third embodiment of the present invention is shown in FIGS. 14 to 20. The warp let-off motion shown in FIG. 14 is almost the same as that of FIG. 1. The speed change transmission 17 of FIG. 14 is the same as the one shown in FIGS. 4 to 9. In the third embodiment, the double acting air cylinder 84 and the solenoid valve 86 are employed as in the second embodiment.

The piston rod 85 of the air cylinder 84 is connected to the end of the forward-reverse shift lever 59 of the speed change transmission 17. When the solenoid valve 86 is energized, it supplies air to a lower pressure chamber of the air cylinder 84. By so doing, the solenoid valve 86 causes the piston rod 85 to move upward in FIG. 16, and the forward-reverse lever 59 to rotate in the clockwise direction in FIG. 16 to the forward position. When the solenoid valve 86 is not energized, it supplies air to an upper pressure chamber of the air cylinder 84 to move the piston rod 85 downward in FIG. 16. The downward movement of the piston rod 85 causes the forward-reverse lever 59 to rotate in the counterclockwise direction in FIG. 16, and shift to the reverse position.

In order to detect the positions of the forward-reverse lever 59, there are provided two proximity switches 170 and 171. An iron piece 169 is fixed to the end of the forward-reverse lever 59. The first proximity switch (LSF) 170 closely faces the iron piece 169 when the forward-reverse lever 59 is in the forward position. The second proximity switch (LSR) 171 faces the iron piece 169 closely when the forward-reverse lever 59 is in the reverse position. The proximity switches 170 and 171 are fixed to the case 40 of the speed change transmission 17 through brackets 172 and 173, respectively. The proximity switches 170 and 171 are incorporated in a circuit shown in FIG. 17, for controlling a main motor 174 and a brake 175 of the loom, and the solenoid valve 86.

The main motor 174 of the loom is connected to a power source through a contact 176*a* of a motor forward contactor (MF) 176. The main motor 174 is further connected to the power source through a contact 177*a* of a motor reverse contactor (MR) 177.

The brake 175 of the loom is connected to the power source through a contact 179*a* of a brake contactor (BR) 179 and a transformer 178.

The air switching solenoid valve 86 is connected to the power source through a contact 180*a* of an air valve contactor (AV) 180 and through the transformer 178.

Figure 17:
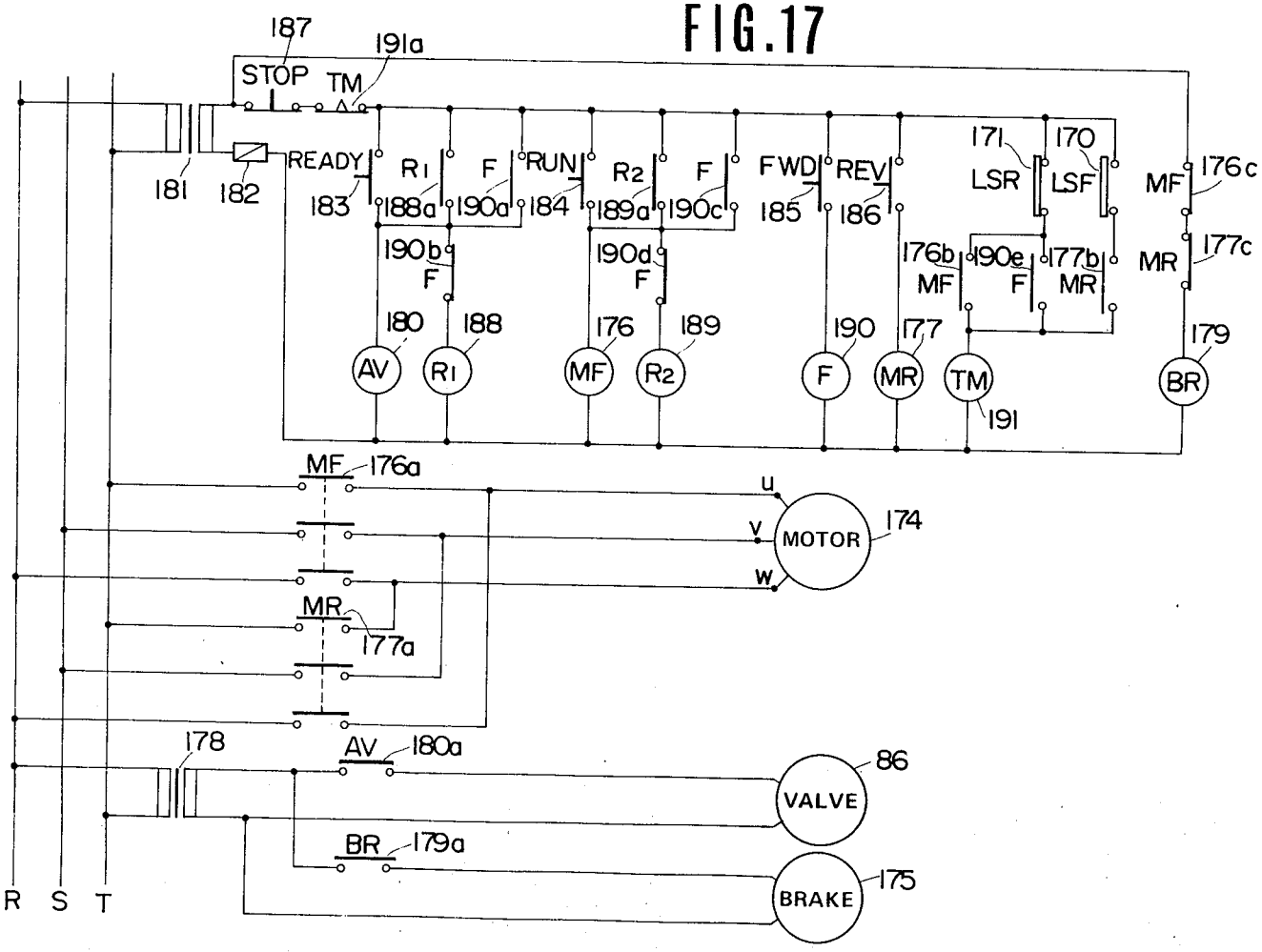
FIG. 17 is a circuit diagram of a control circuit combined with the weaving machine of FIG. 14.
Figure 18:
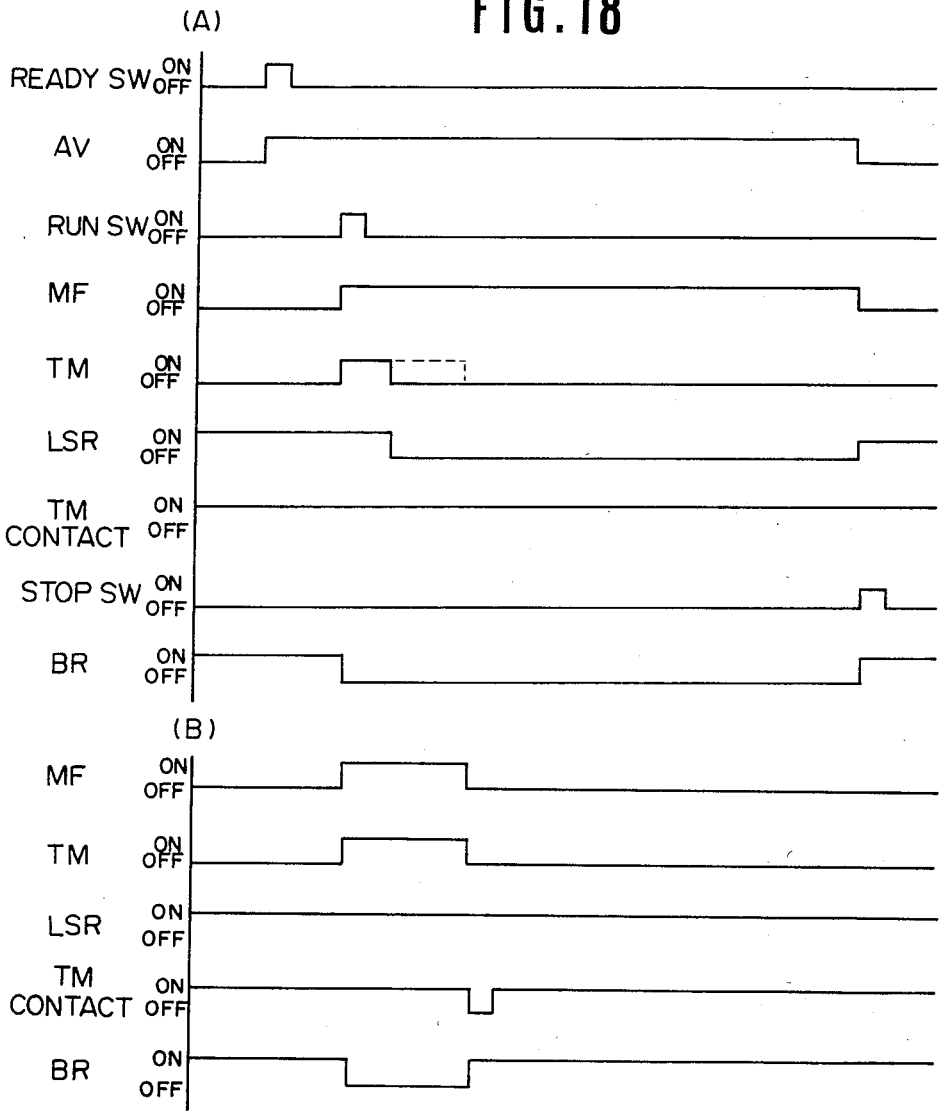
FIGS. 18 to 20 are timing charts for showing the operations of the circuit of FIG. 17.

In the circuit of FIG. 17, there are further provided a transformer 181, a fuse 182, a ready switch 183, a run switch 184, a forward inching switch 185, a reverse inching switch 186, a stop switch 187, a first holding contactor (R1) 188 having a contact 188*a*, a second holding contactor (R2) 189 having a contact 189*a*, a forward inching contactor (F) having contacts 190*a*–190*e*, a timer (TM) 191 having a timer contact 191*a*. The motor forward contactor 176 further has contacts 176*b* and 176*c*. The motor reverse contactor 177 further has contacts 177*b* and 177*c*.

When the ready switch 183 is closed, the first holding contactor 188 is energized to close the contact 188*a*, so that the circuit is latched. At the same time, the air valve contactor 180 is energized, so that the contact 180*a* is closed and the air valve 86 is energized. Accordingly, the air cylinder 84 shifts the forward-reverse lever 59 of the speed change transmission 17 to the forward position.

When the run switch 184 is closed subsequently, the second holding contactor 189 is energized, and its contact 189*a* is closed so that the circuit is latched. At the same time, the motor forward contactor 176 is energized, and its contact 176*a* is closed. Thus, the main motor 174 starts running in the forward direction. The contact 176*c* of the motor forward contactor 176 is opened simultaneously, so that the brake contactor 179 is deenergized, its contact 179*a* is opened, and the brake 175 is disengaged. Thus, the forward operation of the loom is started by first closing the ready switch 183, and then the run switch 184.

The contact 176*b* is closed by the action of the motor forward contactor 176. If, however, the forward-reverse lever 59 has been shifted to the forward position by then, the timer 191 is not energized, and its contact 191 remains closed because the proximity switch 170 is in its on state, and the proximity switch 171 is in its off state.

If the forward-reverse lever 59 has not been shifted to the forward position by the time of closure of the contact 176*b*, the proximity switch 171 remains in the on state, and accordingly the timer 191 is energized. The timer 191 is arranged to open the contant 191*a* at the end of a predetermined time interval if it is kept energized for the predetermined time interval. If the forward-reverse lever 59 is shifted to the forward position within the predetermined time interval of the timer 191, the proximity switch 171 is turned off, and the timer 191 is deenergized in the middle of the predetermined time interval. Therefore, the contact 191*a* of the timer 191 is kept closed, as shown in (A) of FIG. 18.

If the forward-reverse lever 59 is not shifted to the forward position within the predetermined time interval of the timer 191, the timer contact 191 is opened temporarily, so that the air valve contactor 180, the first holding contactor 188, the motor forward contactor 176, the second holding contactor 189 are brought to the deenergized state. Accordingly, the main motor 174 is deenergized with the opening of the contact 176*a*, and the brake 179 is actuated with the closure of the contact 176*c*, as shown in (B) of FIG. 18. Thus, the loom is brought to a stop by the action of the timer 191 and the timer contact 191*a* when the forward-reverse lever 59 of the speed change transmission is not shifted correctly.

When the stop switch 187 is opened during the operation of the loom, the loom is brought to a stop in the same manner as in the case that the timer contact 191*a* is opened.

The forward inching operation of the loom can be started by closing the forward inching switch 185. While the forward inching switch 185 is closed, the forward inching contactor 190 is kept energized. During this, the forward inching contactor 190 keeps the air valve contactor 180 energized by closing the contact 190*a*, and also keeps the motor forward contactor 176 energized by closing the contact 190*c*. In this case, however, the forward inching contactor 190 opens the contacts 190*b* and 190*d*, and accordingly the first and second holding contactors 188 and 189 are not energized. While the air valve contactor 180 is energized, the contact 180*a* is closed, and the air valve 86 is energized. Therefore, the air valve 86 shifts the forward-reverse lever 59 of the speed change transmission 17 to the forward position with the aid of the air cylinder 84. While the motor forward contactor 176 is energized, the contact 176*a* is closed, and the main motor 174 is driven in the forward direction. In this case, a speed control circuit (not shown) maintains the main motor 174 at a slow speed. The motor forward contactor 176 opens the contact 176*c*, and deenergizes the brake contactor 179. The brake contactor 179 opens the contact 179*a*, and deactivates the brake 175.

Figure 19:
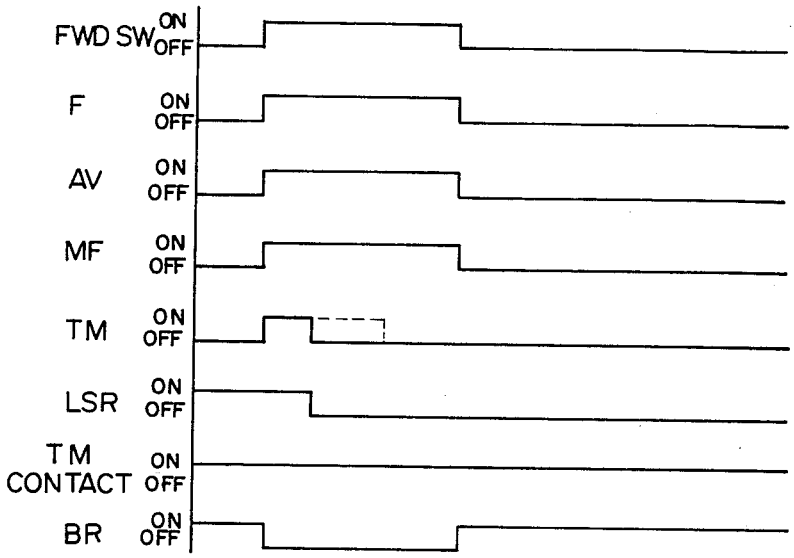

The forward inching contactor 190 closes the contact 190*e*, and thereby energizes the timer 191 if the proximity switch 171 is on. If the air cylinder 84 shifts the forward-reverse lever 59 to the forward position during the time from the start of the timer 191 to the end of the predetermined time interval of the timer 191, the proximity switch 171 is turned off, and the timer 191 is deenergized in the middle of the time interval. Therefore, timer contact 191 remains closed, as shown in FIG. 19.

If the forward-reverse lever 59 is not shifted to the forward position within the predetermined time interval of the timer 191, the timer contact 191*a* is opened temporarily, so that the air valve contactor 180 and the motor forward contactor 176 are deenergized. Therefore, the main motor 174 is deenergized with the opening of the contact 176*a*, and the brake 179 is actuated with the closure of the contact 176*c*. Thus, the forward inching operation is interrupted.

The reverse inching operation can be started by closing the reverse inching switch 186. While the reverse inching switch 186 is closed, the motor reverse contactor 177 is energized, its contact 177*a* is closed, and accordingly the main motor 174 is driven in the reverse direction. In this case, too, the main motor 174 is driven at a slow speed. At the same time, the motor reverse contactor 177 opens the contact 177*c*, and thereby deenergizes the brake contactor 179. Therefore, the contact 179*a* is opened, and the brake 175 is deactivated. The air valve contactor 180 is not energized, and the contact 180*a* remains open. Therefore, the air valve 86 remains deenergized, so that the forward-reverse lever 59 of the speed change transmission 17 is shifted to the reverse position.

Figure 20:
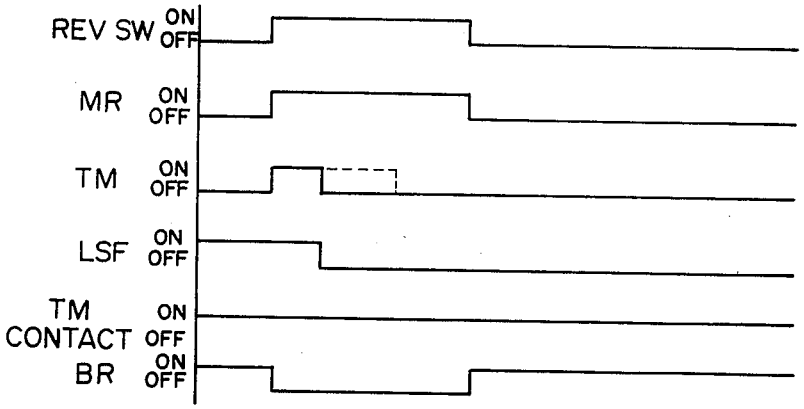

The motor reverse contactor 177 closes the contact 177*b*. If, however, the proximity switch 170 is in the off state, the timer 191 is not energized. If the proximity switch 170 is in the on state, the timer 191 is energized. If the forward-reverse lever 59 is shifted to the reverse position within the predetermined time interval from the start of the timer 191, the proximity switch 170 is turned off, the timer 191 is deenergized halfway, and accordingly the timer contact 191 is not opened, as shown in FIG. 20.

If the forward-reverse lever 59 is not shifted to the reverse position within the predetermined time interval of the timer 191, the timer contact 191*a* is opened temporarily, so that the motor reverse contactor 177 is deenergized. Therefore, the motor reverse contactor 177 deenergizes the main motor 174 by opening the contact 177*a*, and actuates the brake 175 by closing the contact 177*c*. Thus, the reverse inching operation is interrupted.

It is optional to use a computer for performing the above-mentioned control operations.

Figure 21:
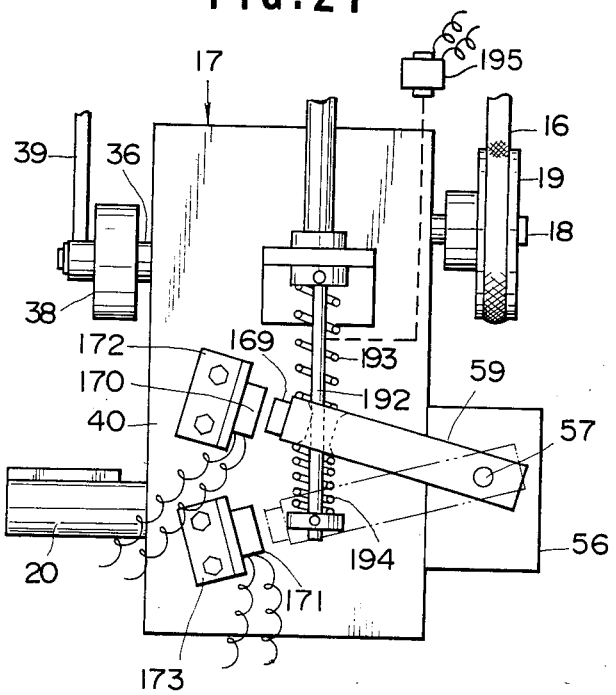
FIG. 21 is a side view of a speed change transmission of another type.

FIG. 21 shows another example of the mechanism for shifting the forward-reverse lever 59 of the speed change transmission. In this example, a solenoid 195 is used in place of the air cylinder 84 and the air valve 86. The forward-reverse lever 59 of the speed change transmission 17 is connected, by a wire 192, to a movable iron core of the solenoid The forward-reverse lever 59 can be shifted by energizing and deenergizing the solenoid 195. There are provided springs 193 and 194 so that the longitudinal movement of the wire 192 is transmitted to the forward-reverse lever 59 through the springs 193 and 194. If the movable iron core of the solenoid is conected directly to the forward-reverse lever 59 without the springs 193 and 194, there would be a fear that the speed change transmission may be damaged when the engagement of the one-way clutch of the transmission 17 is very firm. The solenoid is put in the place of the air valve 86 in the circuit of FIG. 17.

What is claimed is:

1. A weaving system comprising driving means, a weaving mechanism connected with said driving means, said weaving mechanism being driven by said driving means in a forward direction and a reverse direction, said weaving mechanism comprising a main mechanism, and a warp let-off mechanism comprising a warp beam, means for sensing warp tension, and speed change means, said speed change means being connected with said driving means, and driven by said driving means in the forward or reverse direction by receiving an input rotation, said speed change means being connected with said warp beam for driving said warp beam by transmitting an output rotation to said warp beam, said speed change means being connected with said warp tension sensing means, and capable of changing a ratio between the input speed of the input rotation and the output speed of the output rotation thereby to change the speed of the warp beam rotation, said speed change means having shift means for changing the direction of the output rotation, said shift means having a forward shift position and a reverse shift position, said speed change means driving said warp beam in the forward direction when said shift means is in the forward shift position irrespective of whether the input rotation is in the forward direction or in the reverse direction, said speed change means driving said warp beam in the reverse direction when said shift means is in the reverse shift position irrespective of whether the input rotation is in the forward direction or in the reverse direction, operating means connected with said driving means for controlling the operation of said weaving mechanism, said operating means having a forward operation position and a reverse operation position, said driving means driving said weaving mechanism in the forward direction when said operating means is in the forward operation position, and in the reverse direction when said operating means is in the reverse operation position, and interlock means connected with said operating means and said shift means of said speed change means, said interlock means bringing said shift means to the forward shift position when said operating means is in the forward operation position, and to the reverse shift position when said operating means is in the reverse operation position.

2. A weaving system according to claim 1, wherein said driving means is capable of driving said weaving mechanism in a normal run mode and a forward inching mode in the forward direction, and in a reverse inching mode in the reverse direction, said driving means being capable of bringing said weaving mechanism to a stop, said operating means having a run position for the normal run mode and a forward inching position for the forward inching mode as the forward operation position, and a reverse inching position for the reverse inching mode as the reverse operation position, said operating means further having a stop position, said driving means stopping said weaving mechanism when said operating means is in the stop position, said shift means having an idle shift position, said speed change means disconnecting said warp beam from said driving means when said shift means is in the idle shift position, said interlock means bringing said shift means to the forward shift position when said operating means is in the run position and when said operating means is in the forward inching position, and to the reverse shift position when said operating means is in the reverse inching position, said interlock means bringing said shift means to the idle shift position when said operating means is in the stop position.

3. A weaving system according to claim 2, wherein said shift means comprises a shift lever, and said interlock means comprises a wire having a first end portion connected with said shift lever, and a tube enclosing said wire, said wire being arranged to be moved longitudinally relative to said tube by said operating means to move said shift lever.

4. A weaving system according to claim 3, wherein said first end portion of said wire passes through a hole formed in said shift lever, and has a first spring retainer fixed to said wire on one side of said shift lever and a second spring retainer fixed to said wire on the other side of said shift lever, said interlock means further comprising a first spring disposed between said first spring retainer and said shift lever, and a second spring disposed between said shift lever and said second spring retainer.

5. A weaving system according to claim 4, wherein said operating means comprises an operating lever, and said wire has a second end connected with said operating lever.

6. A weaving system according to claim 5, wherein said operating lever is swingable among the run position, the forward inching position, the reverse inching position and the stop position, said operating means further comprising spring means for biasing said operating lever to the stop position, holding means for holding said operating lever in the run position when said operating lever is moved to the run position, and stopping means which, when operated, releases said operating lever from said holding means.

7. A weaving system according to claim 4, wherein said interlock means comprises a solenoid and said wire has a second end connected with said solenoid, said solenoid being electrically connected with said operating means.

8. A weaving system according to claim 2, wherein said speed change means comprises an input shaft driven by said driving means, an output shaft for driving said warp beam, transmitting means, connected between said input shaft and said output shaft, for transmitting power from said input shaft to said output shaft, said transmitting means comprising an eccentric, a connecting rod, a driven ring and one-way clutch means, said eccentric having an inner member through which said input shaft is keyed eccentrically and an outer member mounted on said inner member and rotatable round the rim of said inner member for causing said connecting rod to reciprocate rectilinearly, said connecting rod having a first end pivotally connected with said outer member of said eccentric, and a second end pivotally connected with said driven ring, said driven ring being mounted on said output shaft through said one-way dlutch means and being caused to rotate back and forth by the reciprocating movement of said connecting rod, said one-way clutch means being capable of transmitting the movement of said driven ring to said output shaft in a prescribed manner, and regulating means, connected with said warp tension sensing means and said outer member of said eccentric, said regulating means being capable of changing the stroke of the reciprocating movement of said connecting rod by controlling the movement of said outer member in accordance with the warp tension sensed by said warp tension means.

9. A weaving system according to claim 8, wherein said speed change means comprises a plurality of said transmitting means which move periodically with a phase difference from each other by being driven by said input shaft, for driving said output shaft.

10. A weaving system according to claim 9, wherein said regulating means comprises a common shaft which is movable so that it remains generally in parallel with said input shaft, link means connected between said warp tension sensing means and said common shaft, for moving said common shaft relative to said input shaft in accordance with the warp tension sensed by said warp tension sensing means, and a plurality of control arms each of which has a first end mounted on said common shaft and a second end pivotally connected with one of said outer members of said eccentrics, each of said control arms being swingable on said common shaft.

11. A weaving system according to claim 10, wherein said one-way clutch means of each transmitting means comprises a plurality of rollers and arc members placed alternately in an annular space formed between a cylindrical inner surface of said driven ring and said output shaft, and springs disposed between each neighboring pair of said roller and said arc member, each of said arc members being slidable circumferentially in said annular space, each of said rollers being received in a recess which is formed in said output shaft and has a first portion, a middle portion and a second portion arranged circumferentially, each of said rollers being wedged between the inner surface of said driven ring and said output shaft when said roller is in said first portion of said recess and said driven ring rotates in a first direction, and when said roller is in said second portion and said driven ring rotates in a second direction opposite to said first direction, each of said driven ring being capable of rotating back and forth freely without driving said output shaft when each of said rollers is in said middle portion.

12. A weaving system according to claim 11, wherein said shift means of said speed change means comprises ring means, shift rod and shifter means, said ring means being rotatably mounted on said output shaft and fixedly connected with said arc members of said one-way clutch means so that all of said arc members are rotatable, relative to said output shaft, integrally with said ring means, said shift rod being received in an axially extending bore centrally formed in said output shaft, said shift rod being axially slidable in said axially extending bore, said shift rod having a radially extending pin, said pin passing radially through an axial slot formed in said output shaft and through a slant slot formed in said ring means, said axial slot of said output shaft being axially elongated and allowing said shift rod to move axially by allowing said pin to slide axially in said axial slot, said slant slot being elongated in a slant direction inclined with respect to the axial direction of said output shaft and allowing said pin to slide along said slant direction, said pin sliding along said slant direction in said slant slot and by so doing causing said ring member to rotate relative to said output shaft when said pin moves axially in said axial slot, said shifter means being capable of changing the axial position of said shift rod.

13. A weaving system according to claim 12, wherein said shift rod has a first axial position, a middle axial position and a second axial position, said rollers being held in said first portion by said arc members when said shift rod is in said first axial position, said rollers being held in said middle portion by said arc members when said shift rod is in said middle position, said rollers being held in said second portion by said arc members when said shift rod is in said second position.

14. A weaving system according to claim 13, wherein said shifter means comprises a pinion in mesh with teeth formed in said shift rod, and a shift lever, connected with said pinion, for rotating said pinion.

15. A weaving system according to claim 1, further comprising shift error stop means for detecting an error condition in which said shift means is in the forward shift position while said operating means is in the reverse operation position, or said shift means is in the reverse shift position while said operating means is in the forward operation position, said shift error stop means being connected with said driving means for causing said driving means to stop the motion of said weaving mechanism if said error condition continues during a predetermined time interval.

16. A weaving system according to claim 15, wherein said shift error stop means comprises shift position detecting means for detecting the shift positions of said shift means, and timer means connected with said shift position detecting means and said operating means, said timer means being energized when said error condition exists, and deenergized when said error condition does not exist, said timer means causing said driving means to stop the motion of said weaving mechanism at the end of the predetermined time interval if said timer means remains energized during the predetermined time interval.

17. A weaving system according to claim 16, wherein said driving means is capable of driving said weaving mechanism in a normal run mode and a forward inching mode in the forward direction, and in a reverse inching mode in the reverse direction, said driving means being capable of bringing said weaving mechanism to a stop, said operating means having a run position and a forward inching position as the forward operation position, and a reverse inching position as the reverse operation position, said operating means further having a stop position, said driving means stopping said weaving mechanism when said operating means is in the stop position, said shift means having an idle shift position, said speed change means disconnecting said warp beam from said driving means when said shift means is in the idle shift position, said interlock means bringing said shift means to the forward shift position when said operating means is in the run position and when said operating means is in the forward inching position, and to the reverse shift position when said operating means is in the reverse inching position, said interlock means bringing said shift means to the idle shift position when said operating means is in the stop position, said shift error stop means bringing said operating means to the stop position if said error condition continuous to exist during the predetermined time interval.

18. A weaving system according to claim 17, wherein said shift position detecting means comprises a first proximity switch which is in an on state only when said shift means is in the forward shift position, and a second proximity switch which is in an on state only when said shift means is in the reverse shift position.

19. A weaving system according to claim 18, wherein said driving means comprises motor means capable of driving said weaving mechanism in the normal run mode, forward inching mode and reverse inching mode, and a brake for stopping the motion of said weaving mechanism, wherein said interlock means comprises an interlock relay which holds said shift means in the forward shift position while said interlock relay is energized, wherein said timer means has a timer contact, and wherein said operating means comprises (a) a stop switch capable of being in an open state and a closed state, (b) a first holding relay which holds said interlock relay energized while said first holding relay is energized, (c) a ready switch, connected with said interlock relay and said first holding relay, for energizing said interlock relay and said first holding relay when said ready switch is in an closed state, said first holding relay being held energized after said ready switch is turned to an open state until said stop switch is turned to the open state or said timer contact is opened, (d) a motor forward relay which holds said motor means in the condition for driving said weaving mechanism in the forward direction while said motor forward relay is energized, (e) a second holding relay which holds said motor forward relay energized while said second holding relay is energized, (f) a run switch, connected with said motor forward relay and said second holding relay, for energizing said motor forward relay and said second holding relay when said run switch is in an closed state, said second holding relay being held energized after said run switch is turned to an open state until said stop switch is turned to the open state or said timer contact is opened, (g) a forward inching relay which holds said motor forward relay energized, said motor means in the condition for the forward inching mode and said first and second holding relay deenergized while said forward inching relay is energized, (h) a forward inching switch, connected with said forward inching relay, for energizing said forward inching relay when said forward inching switch is in a closed state, (i) a reverse inching relay which holds said motor means in the condition for the reverse inching mode while said reverse inching relay is energized, (j) a reverse inching switch, connected with said reverse inching relay, for energizing said reverse inching relay when said reverse inching switch is in a closed state, and (k) a brake relay which holds said brake activated while said brake relay is energized, said brake relay being held deenergized while said motor forward relay is energized or said reverse inching relay is energized, said timer means being held energized while said first proximity switch is in the on state and said reverse inching relay is energized or while said second proximity switch is in the on state, and either or both of said motor forward relay and said forward inching relay is energized, said interlock relay, first holding relay, motor forward relay, second holding relay, forward inching relay, reverse inching relay and timer means being deenergized while said stop switch is in the open state or said timer contact is opened.

20. A weaving system according to claim 1, wherein said interlock means comprises a double acting air cylinder having a piston connected with said shift means, and a solenoid valve for controlling the air supply to said air cylinder, said solenoid valve being electrically connected with said operating means.

21. A weaving system according to claim 15, wherein said interlock means further comprises a double acting air cylinder having a piston connected with said shift means, and a solenoid valve for controlling the air supply to said air cylinder, said solenoid valve being electrically connected with said interlock relay.

22. A weaving system according to claim 16, wherein said interlock means further comprises a double acting air cylinder having a piston connected with said shift means, and a solenoid valve for controlling the air supply to said air cylinder, said solenoid valve being electrically connected with said interlock relay.

23. A weaving system according to claim 19, wherein said interlock means further comprises a double acting air cylinder having a piston connected with said shift means, and a solenoid valve for controlling the air supply to said air cylinder, said solenoid valve being electrically connected with said interlock relay.

* * * * *